United States Patent [19]

Lane, Sr.

[11] Patent Number: 4,747,520

[45] Date of Patent: May 31, 1988

[54] DEVICE FOR DISPENSING LIQUID FROM A BOTTLE

[76] Inventor: Donald W. Lane, Sr., Rte. 2, Box 315, Atoka, Tenn. 38004

[21] Appl. No.: 19,782

[22] Filed: Feb. 27, 1987

[51] Int. Cl.[4] ..... B67D 5/06

[52] U.S. Cl. ..... 222/181; 222/481

[58] Field of Search ..... 285/305; 222/183, 185, 222/153, 478, 481, 481.5, 511, 514, 545, 173, 180–181, 518; 248/121, 127

[56] References Cited

U.S. PATENT DOCUMENTS

| | | | |
|---|---|---|---|
| 999,602 | 8/1911 | Slee | 222/185 |
| 1,368,703 | 2/1921 | Czerny | 222/185 |
| 1,445,058 | 2/1923 | Appel | 222/481 X |
| 2,117,791 | 5/1938 | Damsel et al. | 222/185 |
| 3,560,027 | 2/1971 | Graham | 285/305 X |
| 4,660,742 | 4/1987 | Ozdemir | 222/36 |

FOREIGN PATENT DOCUMENTS

| | | | |
|---|---|---|---|
| 634739 | 2/1928 | France | 222/481 |
| 597594 | 8/1959 | Italy | 222/185 |

*Primary Examiner*—Michael S. Huppert
*Attorney, Agent, or Firm*—Walker & McKenzie

[57] ABSTRACT

A device for allowing liquid to be easily dispensed from a bottle having a mouth and an outwardly extending flange located adjacent the mouth. A stand is supported on a support surface. A body is attached to the upper end of the stand. The body has a bore therethrough for allowing liquid from the bottle to pass therethrough. A dispensing valve is associated with the bore for controlling the passage of liquid from the bottle through the bore. A clamp is attached to the body for engaging and clamping the flange of the bottle to the body with the mouth of the bottle communicating with the inlet end of the bore.

12 Claims, 6 Drawing Sheets

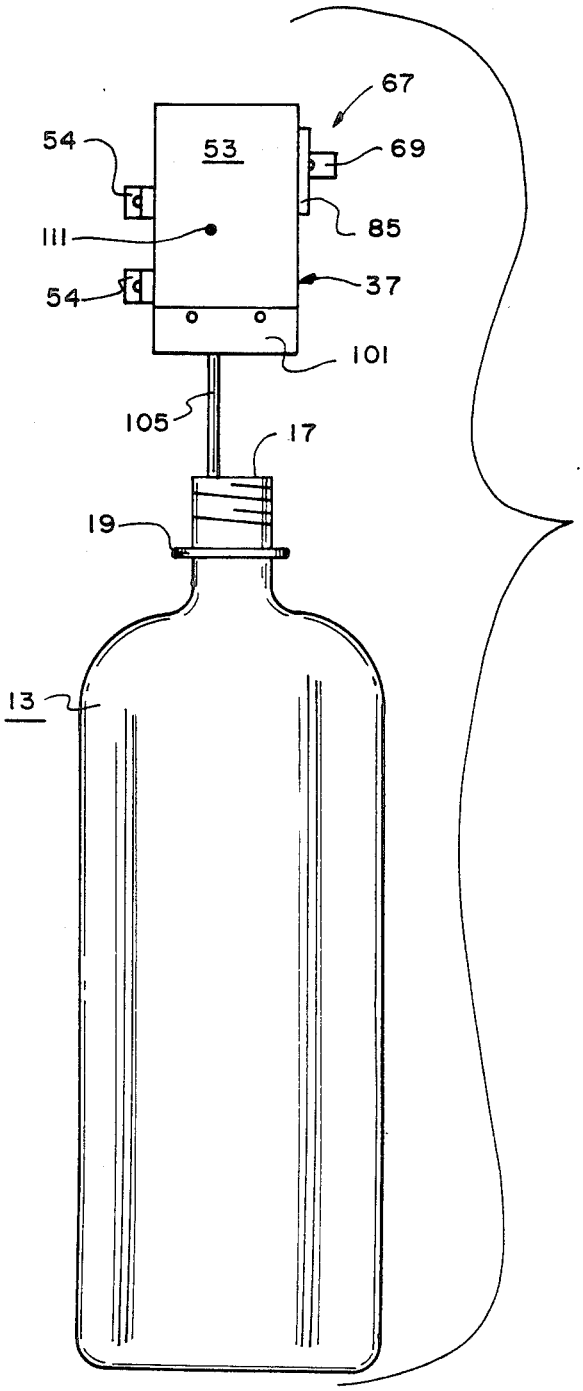
FIG. 5
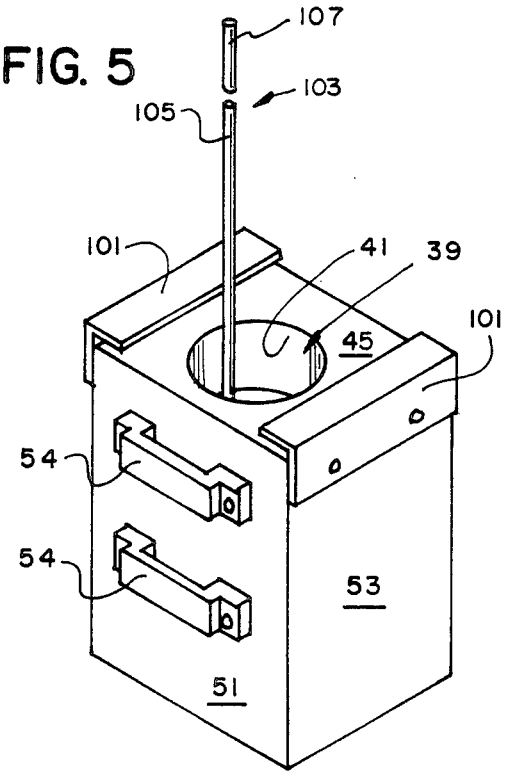
FIG. 4
FIG. 6
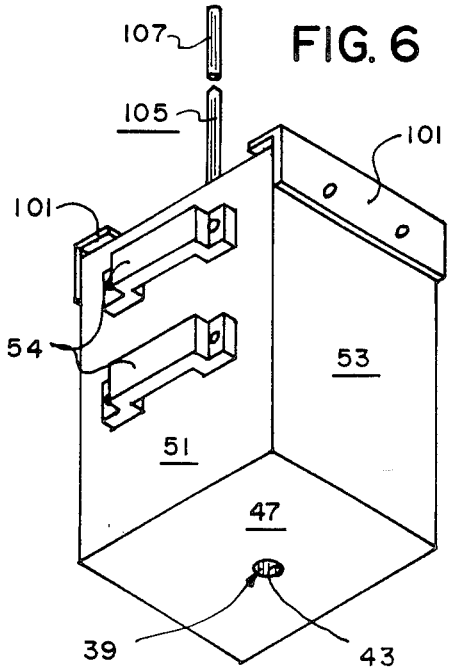

DEVICE FOR DISPENSING LIQUID FROM A BOTTLE

BACKGROUND OF THE INVENTION

1. Field of the Invention:

The present invention relates, in general, to devices for dispensing liquid from bottles and the like.

2. Description of the Related Art:

Heretofore various devices have been developed for dispensing liquid from bottles and the like. A preliminary patentability search conducted in class 222, subclass 181 and 185 disclosed the following patents: U.S. Pat. Nos. 1,368,703 Czerny; 2,117,791 Damsel et al; 2,445,101 Bailey; 2,562,212 Rogers et al; 2,689,669 Ericson; 2,734,659 Smith; and 4,288,007 Rogers et al. None of the above patents disclose or suggest the present invention.

Large drink containers (e.g., 2 or 3 liter plastic soft drink bottles) have become increasingly popular due to the economy of such containers, etc. However, because of the size and weight of such containers, it is difficult to dispense liquid from such containers. One solution is to decant liquid fromt he large container into smaller containers that can be easily handled. However, such a solution adversely affects the freshness of the liquid, especially carbonated drinks. The above identified prior art discloses various rather complicated means used for fountain drinks and the like. However, since the 2 and 3 liter soft drink bottles are intended primarily for home use, it is desirable to provide a simple, non-complicated device for allowing liquid to be dispensed therefrom.

SUMMARY OF THE INVENTION

The present invention is directed toward providing an improved liquid dispensing device. The concept of the present invention is to provide a device for use with large soft drink bottles, or the like, (e.g., the now common 2 or 3 liter plastic soft drink bottles) to allow liquid to be easily dispensed therefrom while maintaining the freshness of the liquid remaining in the bottle.

The device of the present invention includes, in general, a stand having a lower end for being supported on a support surface and having an upper end; body means attached to the upper end of the stand for supporting a bottle, the body having a bore therethrough for allowing liquid from the bottle to pass therethrough; dispensing valve means associated with the bore for controlling the passage of liquid from the bottle through the bore; and clamp means attached to the body means adjacent the inlet end of the bore for engaging and clamping the flange of the bottle to the body means with the mouth of the bottle communicating with the inlet end of the bore.

BRIEF DESCRIPTION OF THE DRAWINGS

FIG. 4 is a somewhat diagramatic view of a portion of the dispensing device showing a bottle being secured thereto.

FIG. 5 is a perspective view of a portion of the dispensing device.

FIG. 6 is a perspective view of a portion of the dispensing device as viewed from below.

DESCRIPTION OF THE PREFERRED EMBODIMENT

Figure 1:
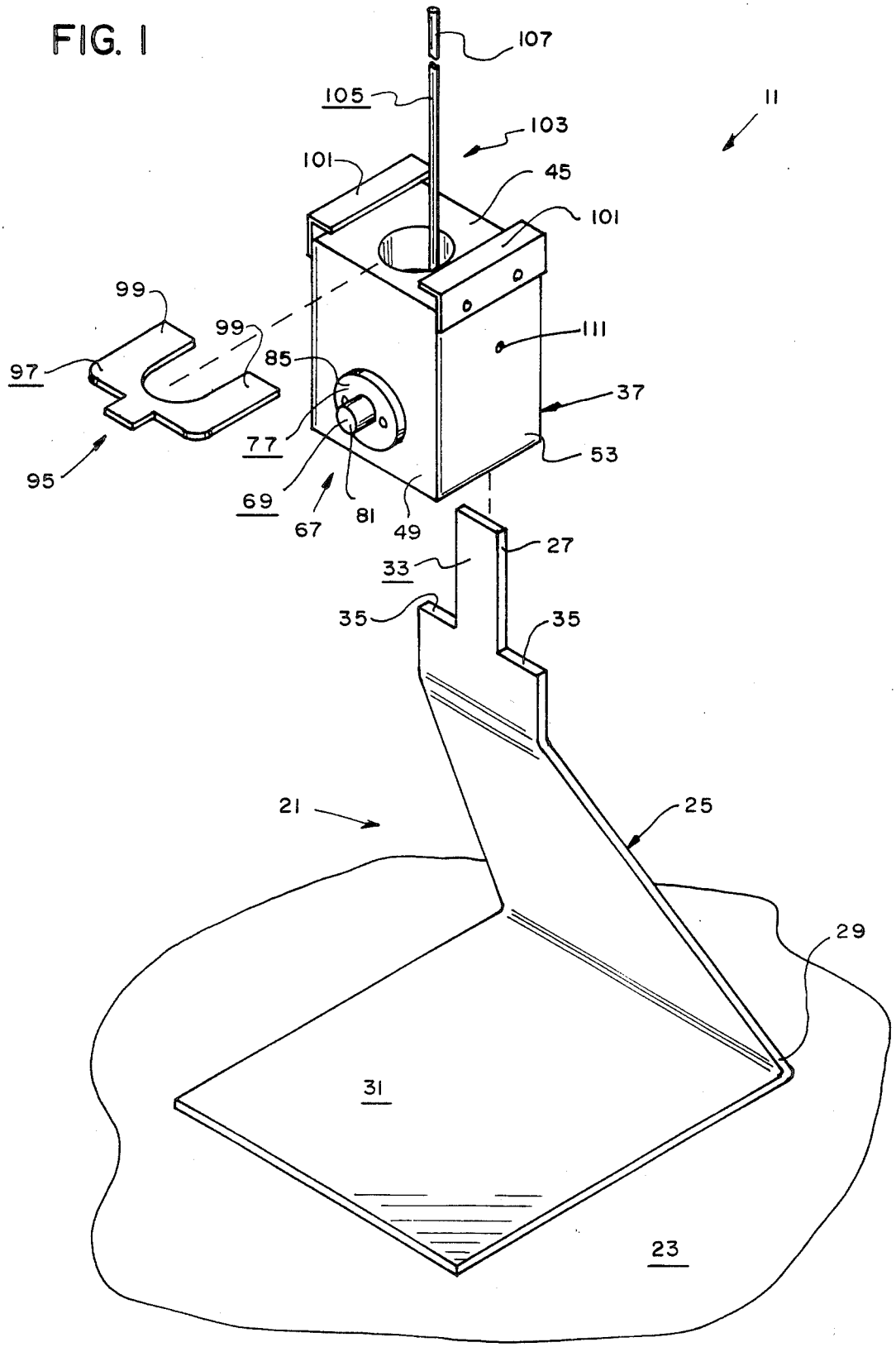
FIG. 1 is an exploded perspective view of the dispensing device of the present invention.

The preferred embodiment of the device 11 for dispensing liquid from a receptacle, such as a bottle 13, into a receptacle, such as a glass 15, (see FIGS. 2 and 3) consists of a non-complicated, easy-to-use combination which will prevent carbonated beverages, such as soft drinks and the like, from losing their carbonation (i.e., from becoming "flat"). The bottle 13 is typically a 2, 3 or 4 liter plastic soft drink bottle having a mouth 17 and an outwardly extending flange 19 adjacent the mouth 17.

Figure 2:
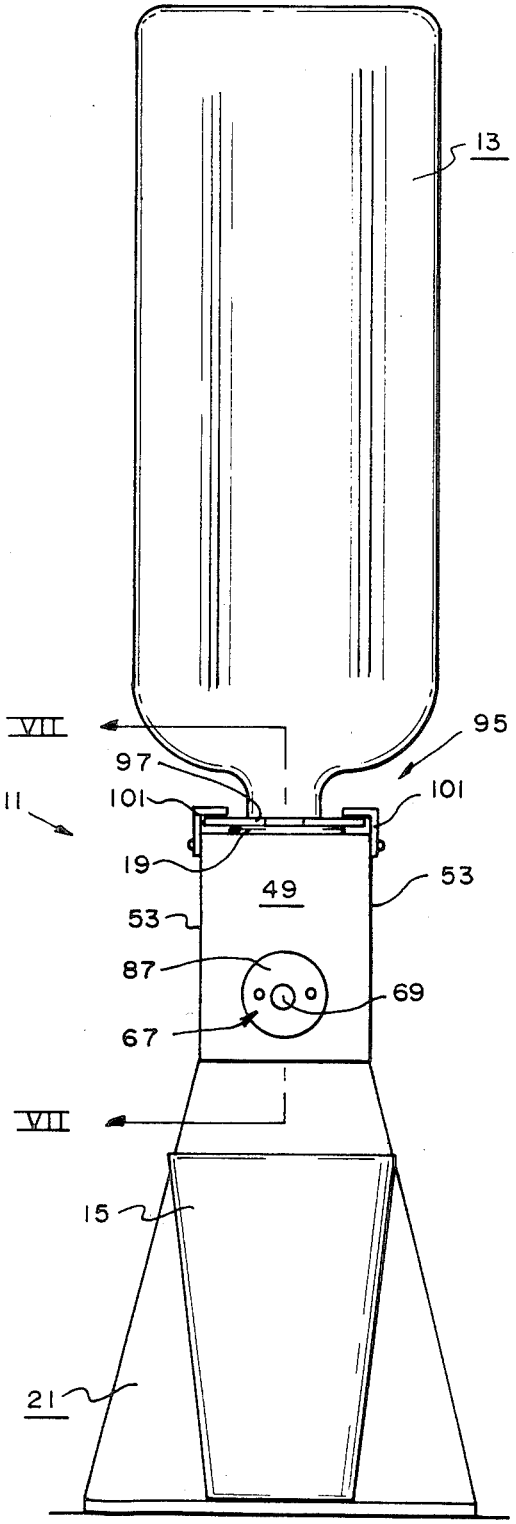
FIG. 2 is a front elevational view of the dispensing device with a bottle supported thereon.
Figure 3:
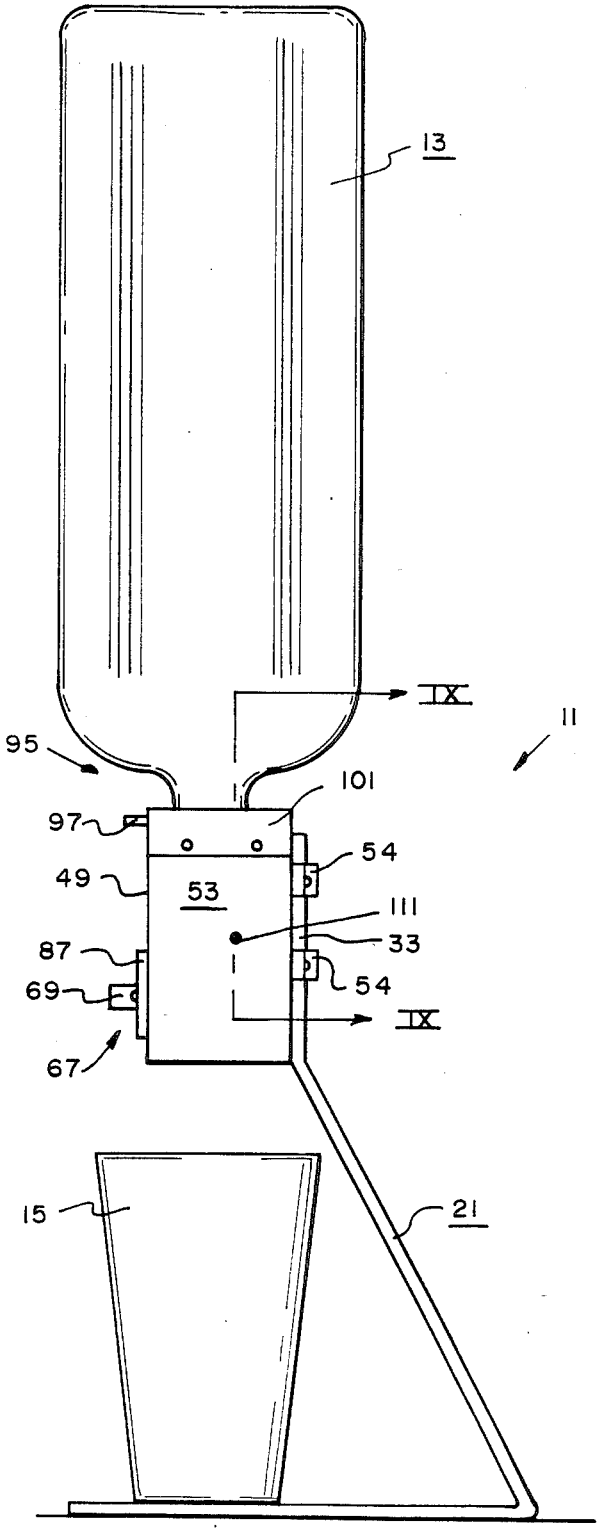
FIG. 3 is a side elevational view of the dispensing device with a bottle supported thereon.

The device 11 includes stand means 21 for being supported on a support surface 23 (see FIGS. 1–3). The stand means 21 preferably includes a vertical member 25 having an upper end 27 and a lower end 29, and a horizontal member 31 associated with the lower end 29 of the vertical member 25 for being supported on the support surface 23. The upper end 27 of the vertical member 25 preferably includes a finger portion 33 and a pair of shoulder portions 35 located on either side of the finger portion 33 for reasons which will hereinafter be described. The specific shape, size and construction of the stand means 21 may vary depending on the size of the bottle 13 to be used, etc., as will now be apparent to those skilled in the art. The horizontal member 31 is sized so as to provide a stable base for the device 11 while the height of the vertical member 25 is sufficient to allow the glass 15 to be positioned beneath the discharge outlet of the device 11 as will hereinafter be described.

The device 11 includes a body means 37 attached to the upper end 27 of the stand means 21 for supporting the bottle 13. The body means 37 has a bore 39 therethrough for allowing liquid from the bottle 13 to pass from the mouth 17 of the bottle 13 through the bore 39 to the glass 15. The bore 39 has an inlet end 41 for communicating with the mouth 17 of the bottle 13 and has an outlet end 43. The body means 37 preferably consists of a block-like structure having a top surface 45, a bottom surface 47, a front surface 49, a rear surface 51 and opposed side surface 53. One or more brackets 54 are preferably attached to the rear surface 51 for receiving the finger portion 33 of the stand means 21 to removably secure the body means 37 to the stand means 21 as will now be apparent to those skilled in the art.

Figure 7:
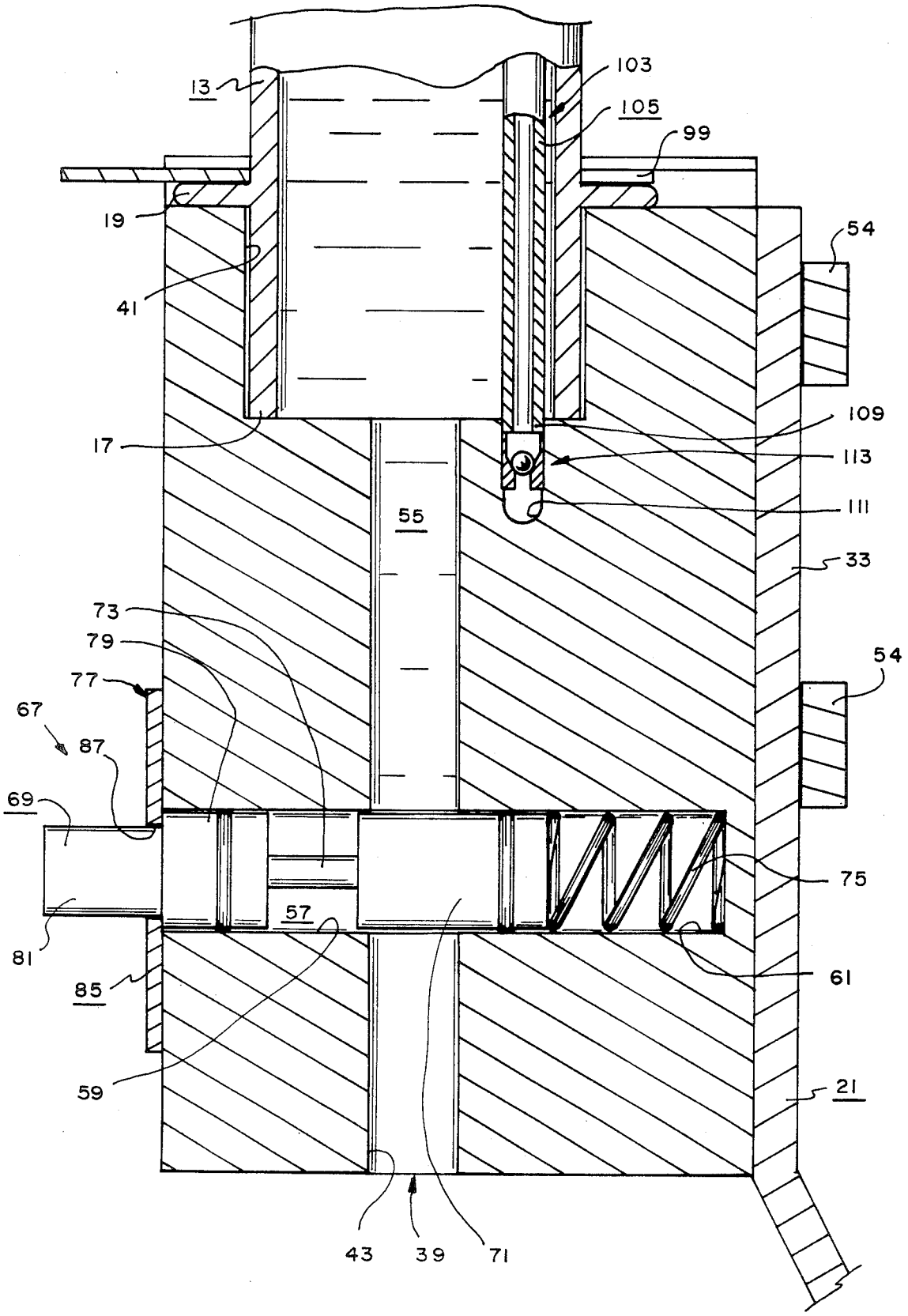
FIG. 7 is an enlarged sectional view substantially as taken on line VII—VII of FIG. 2.
Figure 8:
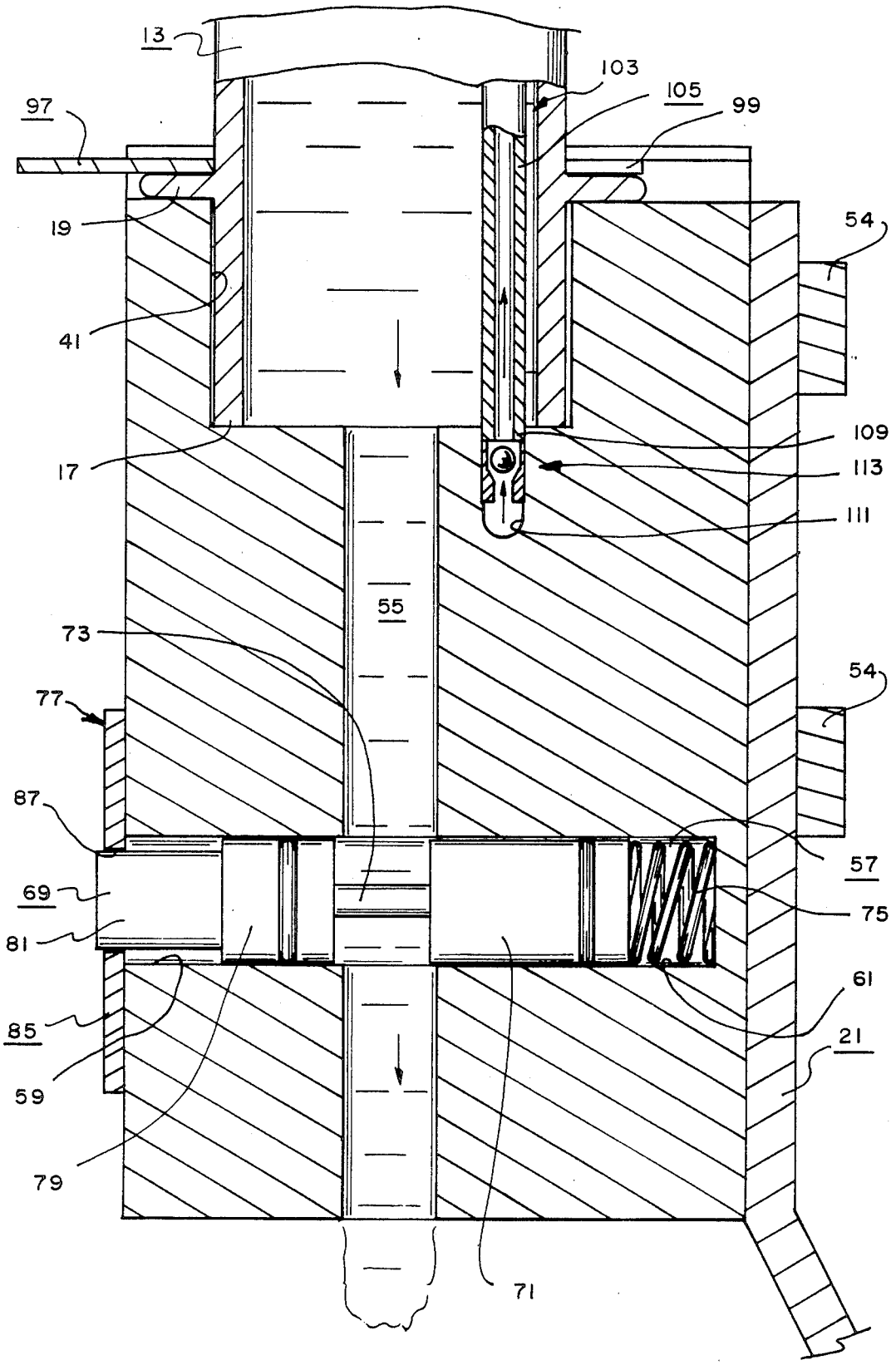
FIG. 8 is a sectional view similar to FIG. 7 but with the valve means of the dispensing device open.
Figure 9:
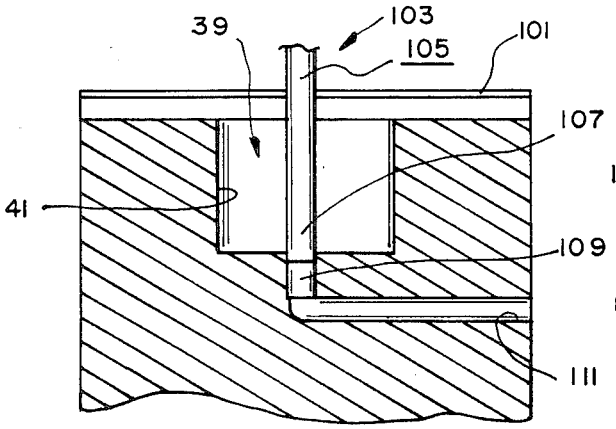
FIG. 9 is a sectional view substantially as taken on line IX—IX of FIG. 3.

In the first embodiment of the body means 37 shown clearly in FIGS. 1–9, the bore 39 has a vertical section 55 extending from the top surface 45 to the bottom surface 47 with the inlet end 41 formed by the upper end of the vertical section 55 and with the outlet end 43 formed by the lower end of the vertical section 55 and with the outlet end 43 located substantially directly beneath the inlet end 41 as clearly shown in FIGS. 7 and 8. In the first embodiment of the body means 37, the bore 39 has a horizontal section 57 which extends from the front surface 49 of the body means 37 at a point intermediate the top and bottom surfaces 45, 47 thereof to a point between the front and rear surfaces 49, 51 thereof intersecting and communicating with the vertical section 55 as clearly shown in FIGS. 7 and 8. The horizontal section 57 of the bore 39 thus preferably has a front portion 59 located between and communicating with the front surface 49 and the vertical section 55 of the bore 39 and has a rear portion 61 communicating with the vertical section 55 of the bore 39 and extending toward the rear surface 51.

Figure 10:
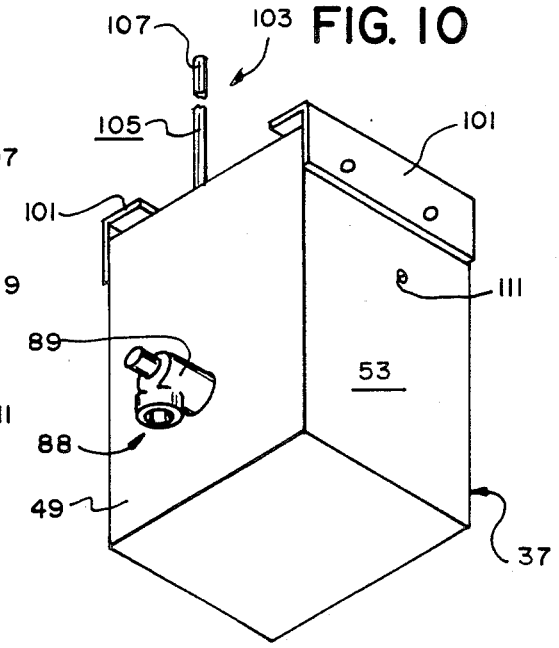
FIG. 10 is a perspective view of a portion of the dispensing device showing a second embodiment of the valve means thereof.
Figure 11:
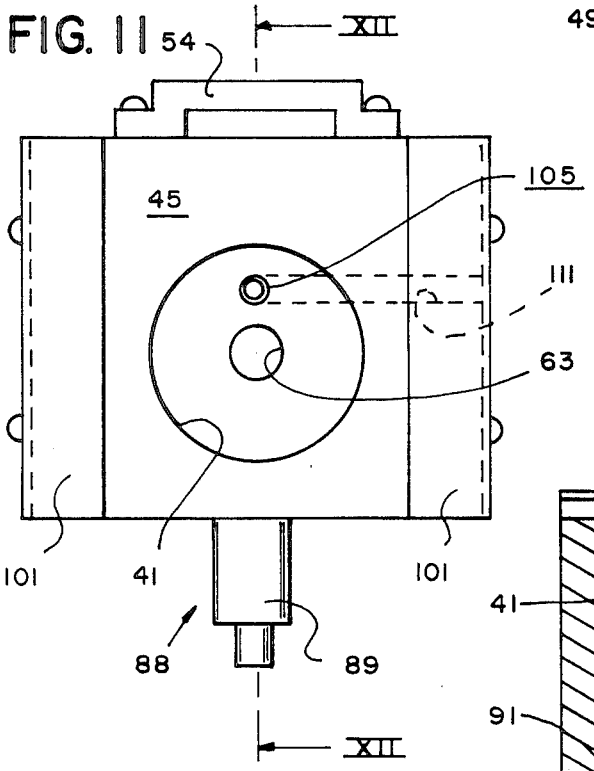
FIG. 11 is an enlarged top plan view of FIG. 10.
Figure 12:
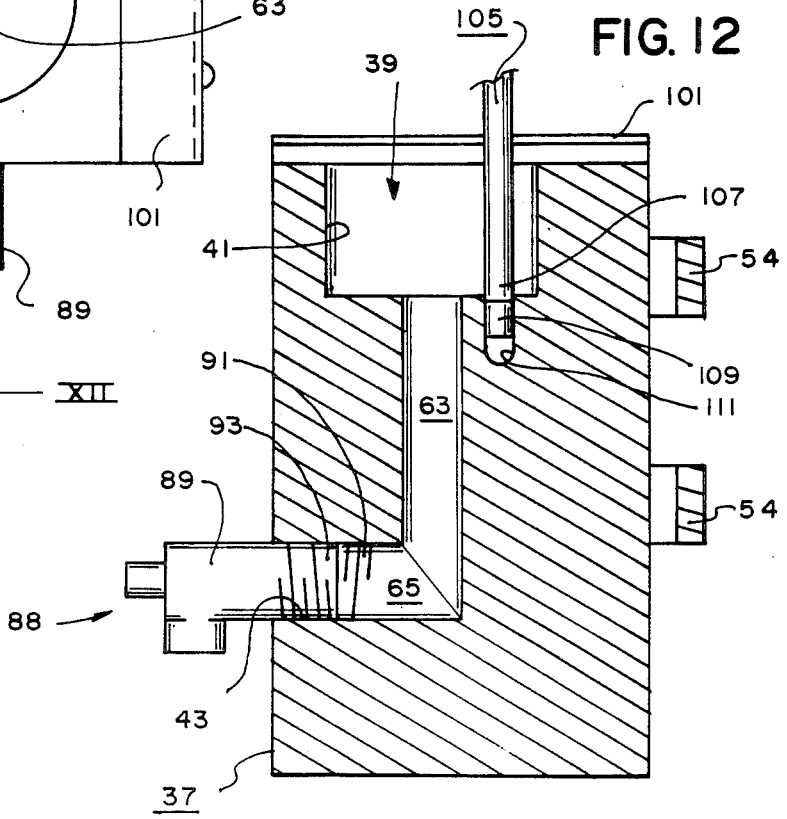
FIG. 12 is a sectional view substantially as taken on line XII—XII of FIG. 11.

In a second embodiment of the body means 37 clearly shown in FIGS. 10, 11 and 12, the bore 39 has a vertical section 63 extending from the top surface 45 toward the bottom surface 47 and has a horizontal section 65 extending from the front surface 49 toward the rear surface 51 with the rear end of the horizontal section 65 intersecting and communicating with the bottom end of the vertical section 63 as clearly shown in FIG. 12.

The device 11 includes a dispensing valve means associated with the bore 39 for controlling the passage of liquid from the bottle 13 through the bore 39.

In a first embodiment of the dispensing valve means shown in, for example, FIGS. 7 and 8, the dispensing valve means is identified by the numeral 67 and preferably includes a valve body member 69 slidably mounted in the horizontal section 57 of the bore 39 for movement between a closed position in which liquid is prevented from passing through the bore 39 and an open position in which liquid is allowed to pass through the bore 39. The valve body member 69 preferably has a first portion 71 positioned within the vertical section 55 of the bore 39 when the valve body member 69 is in the closed position for blocking the vertical section 55 of the bore 39 when the valve body member 69 is in the closed position and has a second portion 73 positioned within the vertical section 55 of the bore 39 when the valve body member 69 is in the open position for allowing fluid to pass through the vertical section 55 of the bore 39 when the valve body member 69 is in the open position. The dispensing valve means 67 preferably includes spring means 75 associated with the body means 37 and the valve body member 69 for normally urging the valve body member 69 to the closed position and preferably includes stop means 77 associated with the body means 37 and the valve body member 69 for preventing the spring means 75 from urging the valve body member 69 past the closed postion. The valve body member 69 preferably includes a third portion 79 and a fourth portion 81. The first and third portions 71, 79 of the valve body member 69 are preferably substantially the same cross-sectional shape and size as the horizontal section 57 of the bore 39 to thereby substantially block the horizontal section 57 of the bore 39. Thus, when the valve body member 69 is in the closed position, the first portion 71 thereof will block both the vertical and horizontal sections 55, 57 of the bore 39 as clearly shown in FIG. 7 and as will now be apparent to those skilled in the art. The second portion 73 of the valve body member 69 is reduced in size as compared to the first portion 71 to allow liquid to pass therearound when the valve body member 69 is in the open position as clearly shown in FIG. 8 and as will now be apparent to those skilled in the art. The fourth portion 81 of the valve body member 69 is also preferably reduced in size as compared to the first and third portions 71, 79, and the stop means 77 preferably consists of a plate 85 for being attached to the front surface 49 of the body means 37 over the access to the horizontal section 57 of the bore 39 with an aperture 87 therethrough. The aperture 87 is sized to allow the fourth portion 81 of the valve body member 69 to extend therethrough while preventing the third section 79 from extending therethrough, thereby acting as a stop to limit the movement of the valve body member 69 in the closed position as will now be apparent to those skilled in the art. The spring means 75 may consist simply of a standard coil spring positioned between the end of the valve body member 69 and the end of the horizontal section 57 of the bore 39 as clearly shown in FIGS. 7 and 8 to thereby normally urge the valve body member 69 to the closed position as will now be apparent to those skilled in the art, while allowing the fourth portion 81 of the valve body member 69 to be manually pushed inward to momentarily hold the valve body member 69 in the open position.

In a second embodiment of the dispensing valve means shown in, for example, FIG. 12, the dispensing valve means is identified by the numeral 88 and preferably includes a body portion 89 for being attached to the outlet end 43 of the bore 39 for controlling the dispensing of liquid through the outlet end 43 of the bore 39, the outlet end 43 of bore 39 preferably has internal threads 91 therein, and the body portion 89 of the dispensing valve means 88 preferably has external threads 93 thereon for coacting with the internal threads 91 in the outlet end 43 of the bore 39 to secure the dispensing valve means 88 thereto. The dispensing valve means 88 is preferably a standard screw-on type valve well known to those skilled in the art and activated by a push-button, lever or the like.

The device 11 includes clamp means 95 attached to the body means 37 adjacent the inlet end 41 of the bore 39 for engaging and clamping the flange 19 of the bottle 13 to the body means 37 with the mouth 17 of the bottle 13 communicating with the inlet end 41 of the bore 39 (see FIGS. 1–3). The clamp means 95 preferably includes a plate means 97 fitting around at least a portion of the flange 19 of the bottle 13 with the mouth 17 of the bottle 13 in communication 2ith the inlet end 41 of the bore 39 for coacting with the body means 37 to trap the flange 19 therebetween. The plate means 97 preferably has a bifurcated end forming a pair of spaced apart finger portions 99 for engaging opposite sides of the flange 19. The clamps means 95 preferably includes bracket means 101 attached to the body means 37 for slidably attaching the plate means 97 to the body means 37. More specifically, the clamp means 95 preferably includes a pair of bracket means 101 with one bracket means 101 mounted on one side of the body means 37 and with the other bracket means 101 mounted on the other side of the body means 37 as shown in FIG. 1. The device 11 preferably includes breather means 103 for allowing air to pass into the interior of the bottle 13 as liquid is dispensed therefrom (see FIG. 1). The breather means 103 preferably includes a breather tube 105 for extending into the interior of the bottle 13 when the bottle 13 is attached to the body means 37. The breather tube 105 has an upper end 107 for being positioned adjacent the upper end of the interior of the bottle 13 when the bottle 13 is positioned on the body means 37 and has a lower end 109 for communicating with the atmosphere. The body means 37 preferably has a bore 111 therethrough with the lower end 109 of the tube 105 attached to one end thereof and with the other end thereof communicating with the atmosphere. The breather means 103 preferably includes check valve means 113 for allowing air to pass into the interior of the bottle 13 while preventing air or liquid from passing to the atmosphere from the interior of the bottle 13 through the breather means 103 (see, in general, FIGS. 7 and 8). The check valve means 113 may be of any typical construction well known to those skilled in the art and may be located at one end of the bore 11, etc.

To use the dispensing device 11 of the present invention, the body means 37 is preferably removed from the stand means 21. Then, with the plate means 97 in an open position and with the typical cap removed from the mouth 17 of the bottle 17, the body means 37 is placed on the bottle 13 with the mount 17 of the bottle 13 extending to the inlet end 41 of the bore 39 and with the breather tube 105 extending into the interior of the bottle 13. The plate means 97 is then moved to a closed position to clamp the flange 19 of the bottle 13 to the body means 37 and thereby secure the bottle 13 to the body means 37. The bottle 13/body means 37 combination is then inverted and attached to the stand means 21 by sliding the finger portion 33 into the brackets 54. The glass 15 can then be positioned beneath the outlet end 43 of the bore 39 and the dispensing valve means activated to allow liquid from the bottle 13 to pass into the galss 15 as will now be apparent to those skilled in the art.

Although the present invention has been described and illustrated with respect to a preferred embodiment and a preferred use therefor, it is not to be so limited since modifications and changes can be made therein which are within the full intended scope of the invention.

I claim:

1. A device for dispensing liquid from a bottle into a receptacle and for holding said bottle above a support surface, said bottle having a mouth and an outwardly extending flange located adjacent said mouth; said device comprising:

(a) a body having a bore therethrough, said bore having an inlet end for receiving said mouth of said bottle and having an outlet end;

(b) dispensing valve means associated with said bore for controlling the passage of liquid from said bottle through said bore;

(c) clamp means attached to said body adjacent said inlet end of said bore for allowing said inlet end of said bore of said body to be inserted over said mouth of said bottle while said bottle is in an upright position and for then engaging and clamping said flange of said bottle to said body with said mouth of said bottle located within said inlet end of said bore, said clamp means including a plate means fitting around at least a portion of said flange of said bottle when said mouth of said bottle is located within said inlet end of said bore for coacting with said body to trap said flange therebetween;

(d) a stand having a lower end for being supported on said support surface and having an upper end including a finger portion; and (e) bracket means attached to said body for allowing said bottle and said body to be inverted as a unit after said bottle is clamped to said body and for then receiving said finger portion of said stand to removably secure said body to said stand with said bottle in the inverted position.

2. The device of claim 1 in which is included a breather means for allowing air to pass into the interior of said bottle as liquid is dispensed therefrom, said breather means including a breather tube having an upper end for being positioned adjacent the upper end of the interior of said bottle and having a lower end communicating with the atmosphere and including check valve means for allowing air to pass into the interior of said bottle from the atmosphere through said breather tube while preventing air or liquid from passing to the atmosphere from the interior of said bottle through said breather means.

3. The device of claim 1 in which said clamp means includes bracket means attached to said body means for slidably attaching said plate means to said body means.

4. The device of claim 3 in which said plate means includes a pair of spaced apart finger portions for engaging opposite sides of said flange.

5. The device of claim 1 in which said dispensing valve means includes a body portion for being attached to said outlet end of said bore for controlling the dispensing of liquid through said outlet end of said bore.

6. The device of claim 5 in which said outlet end of said bore has internal threads therein, and in which said body portion of said dispensing valve means has external threads thereon for coacting with said internal threads in said outlet end of said bore to secure said dispensing valve means thereto.

7. The device of claim 6 in which said bore has a vertical section extending downward from said inlet end thereof and has a horzintal section extending outward from the bottom of said vertical section to said outlet end thereof.

8. The device of claim 1 in which said bore has a vertical section extending downward from said inlet end thereof to said outlet end thereof with said outlet end located substantially directly beneath said inlet end, and has a horizontal section extending from the front of said body means to said vertical section.

9. The device of claim 8 in which said dispensing valve means includes a valve body member slidably mounted in said horizontal section of said bore for movement between a closed position in which liquid is prevented from passing through said bore and an open position in which liquid is allowed to pass through said bore.

10. The device of claim 9 in which said valve body member has a first portion positioned within said vertical section of said bore when said valve body member is in said closed position for blocking said vertical section of said bore when said valve body member is in said closed position and has a second portion positioned within said vertical section of said bore when said valve body member is in said open position for allowing fluid to pass through said vertical section of said bore when said valve body member is in said open position.

11. The device of claim 10 in which said dispensing valve means includes spring means associated with said body means and said valve body member for urging said valve body member to said closed position.

12. The device of claim 11 in which said dispensing valve means includes stop means associated with said body means and said valve body member for preventing said spring means from urging said valve body member past said closed position.

* * * * *